US005518298A

United States Patent [19]

LaPointe et al.

[11] Patent Number: 5,518,298

[45] Date of Patent: May 21, 1996

[54] MOUNTING APPARATUS FOR A MODULAR SOFA ASSEMBLY

[75] Inventors: Larry P. LaPointe, Temperance; Michael R. Mero, Jr., Monroe, both of Mich.

[73] Assignee: La-Z-Boy Chair Company, Monroe, Mich.

[21] Appl. No.: 224,623

[22] Filed: Apr. 5, 1994

[51] Int. Cl.[6] ..... A47C 31/00

[52] U.S. Cl. ..... 297/463.1; 297/440.16; 297/440.14; 297/440.1

[58] Field of Search ..... 297/440.1, 440.14, 297/440.15, 440.16, 440.2, 440.21, 440.22, 452.18, 463.1; 248/200, 205.1, 220.2

[56] References Cited

U.S. PATENT DOCUMENTS

| | | | |
|---|---|---|---|
| D. 83,452 | 2/1931 | Klemm et al. . | |
| D. 155,624 | 10/1949 | Pahlmann . | |
| D. 180,982 | 9/1957 | Woodward . | |
| D. 190,904 | 7/1961 | Kasparian . | |
| 797,826 | 8/1905 | Sherman, Jr. . | |
| 1,335,842 | 4/1920 | Lambert . | |
| 2,201,826 | 5/1940 | Ditchfield | 248/200 |
| 2,716,775 | 9/1955 | Kenimer . | |
| 2,968,338 | 1/1961 | Reese | 297/440.22 X |
| 3,093,410 | 6/1963 | Wilson . | |
| 3,127,216 | 3/1964 | Clouse . | |
| 3,608,959 | 9/1971 | Sarvas | 297/440.15 X |
| 3,635,521 | 1/1972 | Shivvers . | |
| 3,640,569 | 2/1972 | Young . | |
| 4,032,188 | 6/1977 | Jones | 297/440.21 X |
| 4,848,839 | 7/1989 | Galardo . | |
| 4,848,843 | 7/1989 | Gibbs . | |
| 5,000,512 | 3/1991 | Laird | 297/440.1 |
| 5,184,871 | 2/1993 | LaPointe et al. | 297/440.21 |
| 5,234,253 | 8/1993 | LaPointe et al. . | |

*Primary Examiner*—Milton Nelson, Jr.
*Attorney, Agent, or Firm*—Harness, Dickey & Pierce

[57] ABSTRACT

A mounting apparatus for a modular sofa assembly. The apparatus comprises a first bracket member and a second bracket member which are secured to sidewalls and a rear frame bar, respectively, of a fixed seating section of a modular sofa assembly. The first and second bracket members each allow a frame of a seat member of the seating section to be secured to the side walls of the seating section after the side walls have been secured to a pair of frame rails or other like members. In an alternative preferred embodiment a pair of seatback brackets are incorporated for allowing a frame of the seatback member to be secured to the sidewalls of the fixed seating section after the sidewalls have been secured to the frame rails or other like frame members of the sofa assembly. In this manner the seatback member and seat member of the fixed seating section can be upholstered at a location remote from that at which assembly of the sidewalls and other frame members of the sofa assembly takes place. Thus, upholstering of the seatback member and seat member can be accomplished generally simultaneously with other assembly operations to expedite and simplify the assembly process of the sofa assembly.

7 Claims, 3 Drawing Sheets

FIG 3
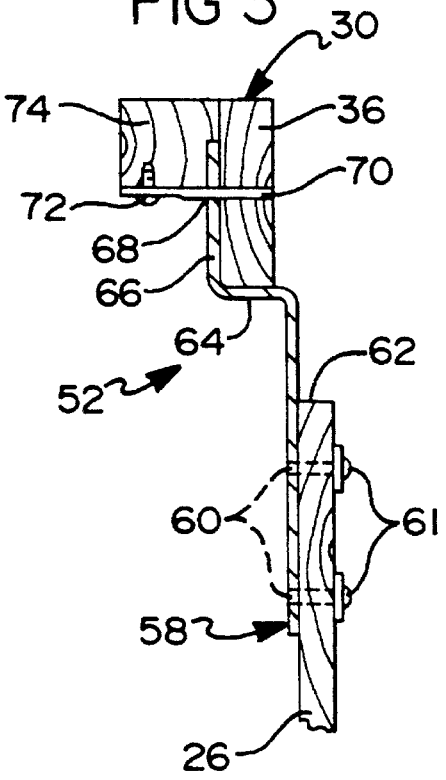
FIG 4
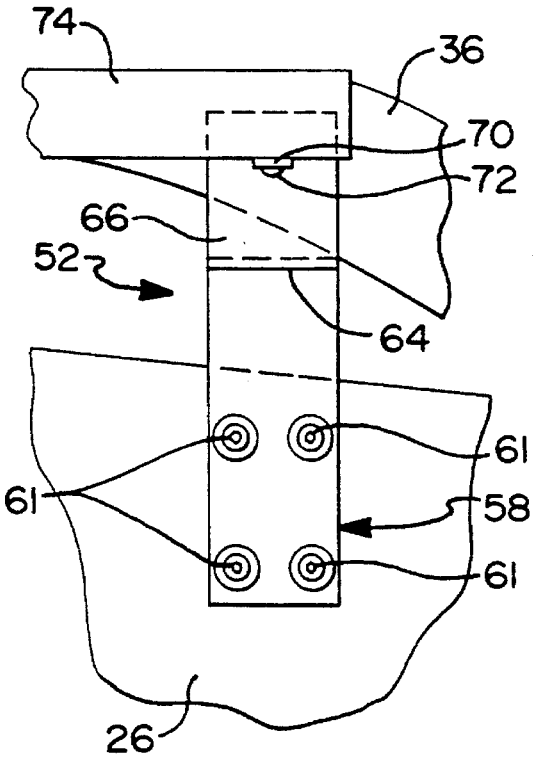
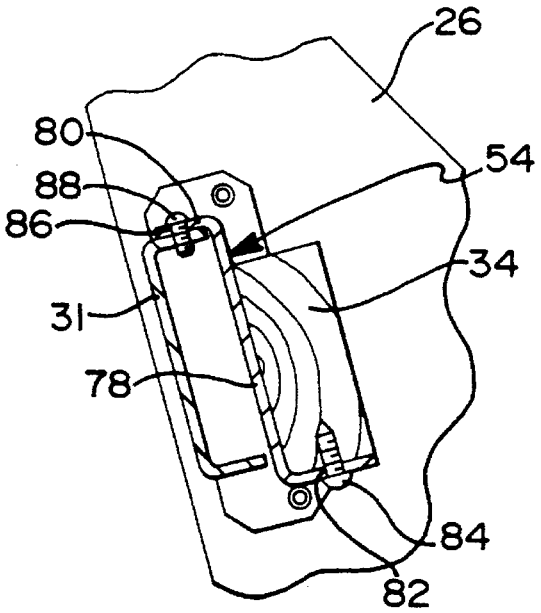
FIG 5
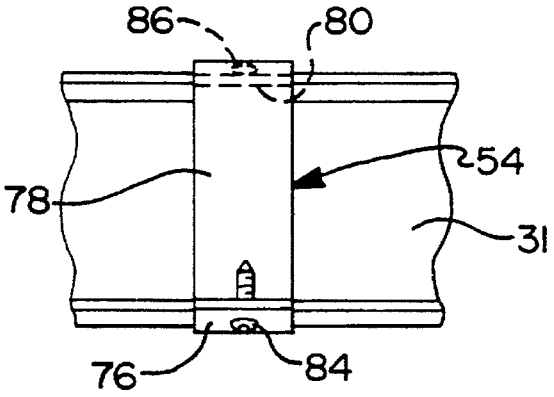
FIG 6

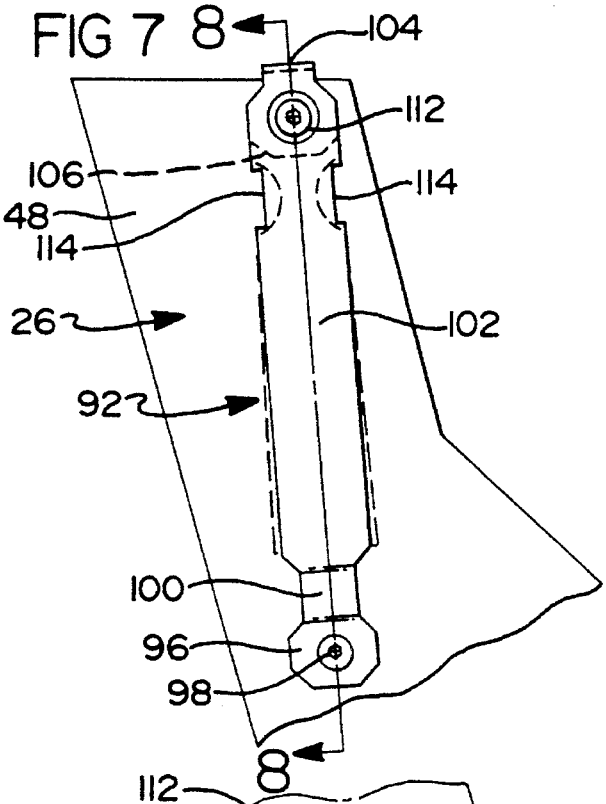
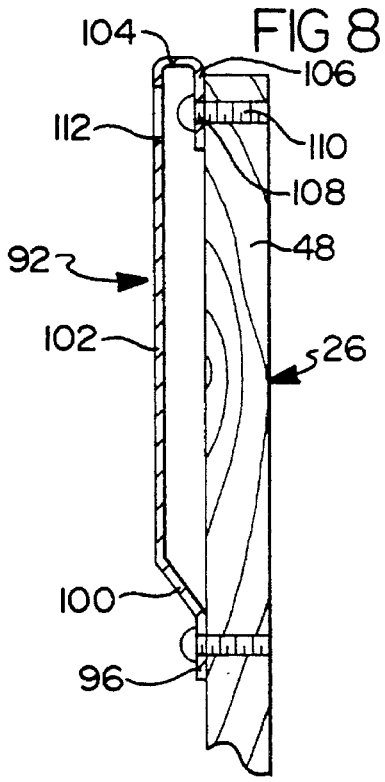
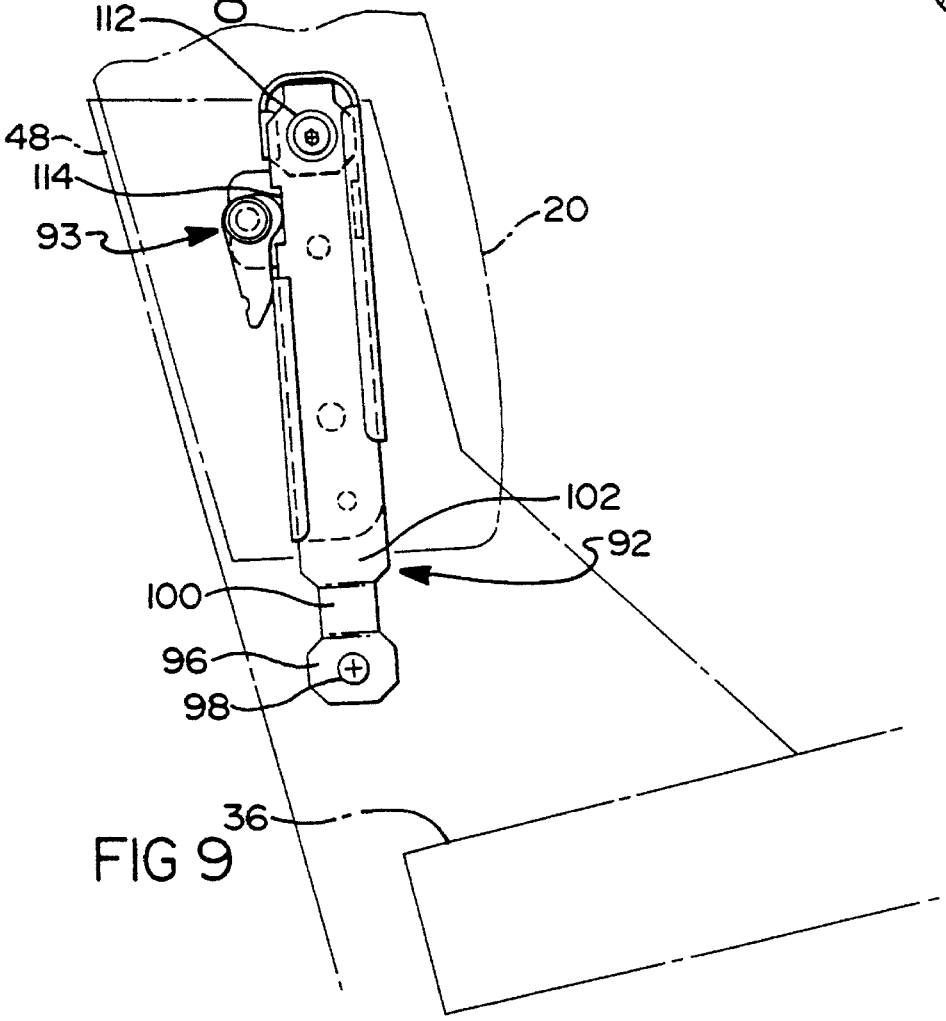
FIG 9

MOUNTING APPARATUS FOR A MODULAR SOFA ASSEMBLY

BACKGROUND OF THE INVENTION

1. Technical Field

This invention relates to modular seating assemblies, and more particularly to an apparatus for enabling a seatback member and a seating member of a fixed seating section to each be upholstered prior to assembly of the fixed seating section and subsequently secured to a pair of side walls of the fixed seating section.

2. Discussion

Modular seating assemblies are used in a wide variety of home and office environments to provide comfortable and convenient seating for a plurality of individuals. Such seating assemblies typically include a plurality of independent seating sections which comprise one or more recliner seating sections and one or more fixed (i.e., non-reclining) seating sections. Frequently, such modular seating assemblies are comprised of three independent seating sections which are secured in a side-by-side arrangement along a pair of frame rails. With regard to the fixed seating sections, these seating sections include a seatback member and a seat member which have typically heretofore been upholstered after the sidewalls of the chair frame have been secured to the frame rails of the modular seating assembly.

While the above described assembly arrangement has proven to be satisfactory in most instances, it would be even further desirable to provide some form of mounting apparatus which enables the seat member and seatback member of a fixed seating section to be completely upholstered and then secured to the side walls of a fixed seating section after the side walls have been secured to the frame rails. Thus, the side walls of the fixed seating section could be secured to the frame rails at a first location while the seatback member and seat member are being upholstered at a separate location. This would significantly increase the efficiency of the assembly process by allowing mechanical assembly operations to be undertaken at the first location while the great majority of the upholstering activities take place at the second location. This assembly arrangement could also reduce the overall assembly time for the seating section because upholstering of the seatback member and seat member would be performed while the side walls of the fixed seating section are being secured to the frame rails.

Accordingly, it is the principal object of the present invention to provide a mounting apparatus for a modular sofa assembly which enables a seatback member and a seat member of a fixed seating section to be secured to a pair of side walls of the fixed seating section after the seatback member and seat member have been upholstered.

It is yet another object of the present invention to provide a mounting apparatus for a modular seating assembly which is relatively inexpensive and easily securable to existing frame-like components of a fixed seating assembly without the need for special tools.

It is still another object of the present invention to provide a mounting apparatus for a modular seating assembly which allows a frame portion of a seat member to be quickly and easily secured to the side walls of the fixed seating section, and which also allows a frame portion of a seatback member to be quickly and easily secured to the side walls after the side walls have been secured to a pair of frame rails of the seating assembly.

SUMMARY OF THE INVENTION

The above and other objects are accomplished by a mounting apparatus for a modular seating assembly in accordance with the preferred embodiments of the present invention. The mounting apparatus includes at least one first bracket member and at least one second bracket member. The first bracket member includes a lower portion which is secured to one of a pair of side walls of the fixed seating section and an upper portion which is secured to a front portion of a frame portion of a seating member. The second bracket member includes an upper portion which is secured to a rear frame-like member extending between the two side walls of the seating section, and a lower ledge portion which supports a rear portion of the frame of the seating member. Accordingly, the frame of the seating member is secured by the first and second bracket members in its proper position between the side walls once it is secured to the first and second bracket members. Accordingly, the frame of the seating member can be upholstered at a remote location and then subsequently secured between the side walls to significantly enhance the assembly process.

In the preferred embodiment at least one seatback bracket member is secured to a portion of one of the side walls for enabling a frame of the seatback member to be coupled to the side walls of the chair via an external, mating bracket assembly secured to the frame of the seatback member. The seatback bracket member thus allows the seatback member to be upholstered as a separate component and then subsequently secured to the side walls of the seating section.

In the preferred embodiment a pair of first bracket members and a pair of seatback bracket members are secured to the side walls of the fixed seating section prior to installing the seat member and seatback member. A pair of second bracket members is secured to a frame member extending between the sidewalls at a rearmost portion of each of the sidewalls. Accordingly, the seatback member and seat member can be upholstered in one location while the side walls are being secured to the frame rails of the seating assembly at another location. Thus, the assembly process is significantly "streamlined" by enabling the assembly of the side walls to the frame rails and the upholstery of the seatback member and seat member to be performed simultaneously if needed or desired. Thus, more of an "assembly line" type of process can be used to construct the modular seating assembly.

In the preferred embodiment of the apparatus, the first bracket members further each include an aperture formed in the upper portion thereof and an associated eye pin for securing the upper portion to the front portion of the frame of the seating member. Each eye pin further includes a threaded fastener associated therewith for securing it to the front portion of the frame of the seat member, to thus serve to "clamp" the upper portion of each first bracket member to the front portion of the frame of the seating member.

BRIEF DESCRIPTION OF THE DRAWINGS

The various advantages of the present invention will become apparent to one skilled in the art by reading the following specification and subjoined claims and by referencing the following drawings in which:

FIG. 3 is a cross sectional view of the first bracket member in accordance with section line 3—3 in FIG. 2.

FIG. 4 is a front view of the first bracket member shown in FIG. 2 attached to a portion of the frame of the seating member;

FIG. 5 is a side cross sectional view of the second bracket member in accordance with section line 5—5 in FIG. 2.

FIG. 6 is a front view of the second bracket member showing same attached to the frame bar extending between the sidewalls;

FIG. 7 is a front view of the seatback bracket member of the present invention;

FIG. 8 is a side cross sectional view of the seatback bracket member in accordance with section line 8—8 in FIG. 7; and FIG. 9 is a side view of the seatback bracket member secured to a mating bracket member of the seatback member.

DETAILED DESCRIPTION OF THE PREFERRED EMBODIMENT

Figure 1:
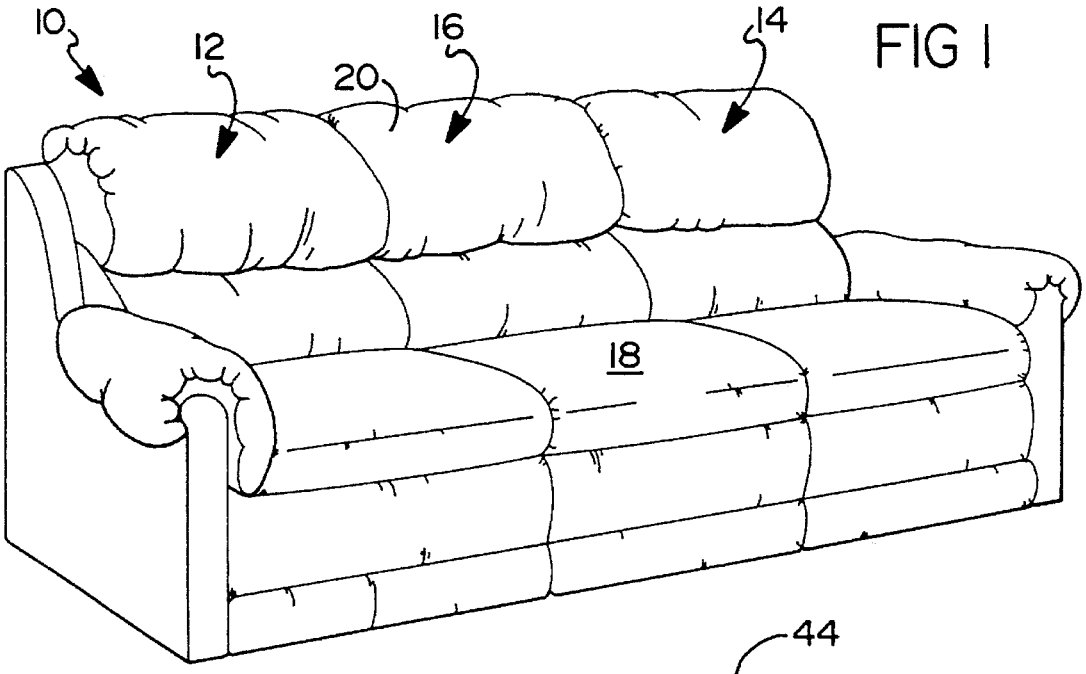
FIG. 1 is a perspective view of a modular sofa assembly incorporating the mounting apparatus of the present invention.

Referring to FIG. 1, there is shown a modular seating assembly in the form of a modular sofa 10. The modular sofa 10 typically comprises a first end seating unit in the form of a recliner chair 12, a second end seating unit in the form of another recliner chair 14, and a center, fixed (i.e., non-reclining) seating section 16. The fixed seating section 16 includes a seat member 18 and a seatback member 20 which are aligned with respect to the seating sections 12 and 14 to form the appearance of a single, integrally formed sofa assembly.

Figure 2:
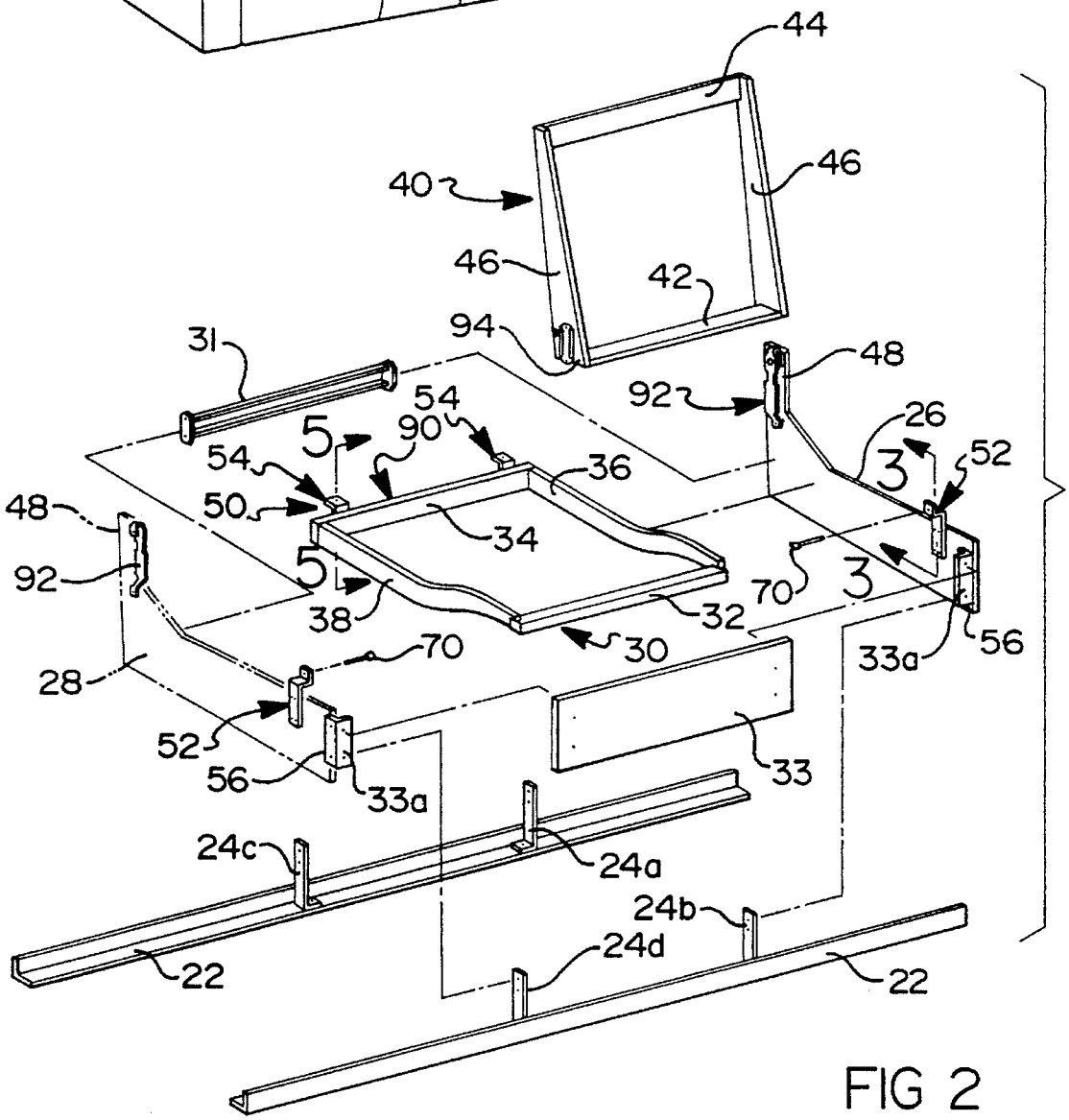
FIG. 2 is an exploded perspective view of the center, fixed seating section and its various components, in addition to the mounting apparatus of the present invention.

Referring to FIG. 2, the construction of the fixed seating section 16 is shown in greater detail. Seating section 16 is secured to a pair of frame rails 22 disposed parallel to one another by a plurality of brackets 24. Preferably two of the brackets **24*a*–24*d* are disposed on each of the frame rails 22 and secured by any suitable fastener, such as a threaded fastener, so as to be fixedly secured to the frame rails 22. The brackets 24*a* and 24*b* are fixedly secured to a lower edge portion of a first side wall 26 of the fixed seating section 16 while the bracket members 24*c* and 24*d* are fixedly secured to a second side wall 28 of the fixed seating section 16. The side walls 26 and 28 are positioned generally parallel to one another by a distance sufficient to allow at least a portion of a frame 30 of the seating member 18 to fit therebetween, and secured to one another by a frame bar 31 and a front frame panel 33 via corner brackets 33*a***, and threaded fasteners (not shown).

With further reference to FIG. 2, the frame 30 generally includes a front cross member 32, a rear cross member 34, a side member 36 and a side member 38. The members 32–38 are secured together to form a generally rigid frame suitable for supporting the weight of the seat occupant.

With continuing reference to FIG. 2, the seatback member 20 also includes a frame 40 having a lower cross member 42, an upper cross member 44 and a pair of side members 46. The members 42–46 are fixedly secured together by any suitable means such as threaded fasteners and/or wood glue to form a seatback frame. The overall width of the seatback member 20 is such as to allow at least a portion thereof to fit between an arm portion 48 of each side wall 26,28.

Referring further to FIG. 2, the seat member 18 and the seatback member 20 of the fixed seating section 16 are secured to the side walls 26 and 28 via a mounting apparatus 50 in accordance with a preferred embodiment of the present invention. The mounting apparatus 50 generally includes a pair of first bracket members 52 and a pair of second bracket members 54. The first bracket members 52 are each secured to an associated one of the side walls 26 and 28 by one or more fasteners such as threaded bolt/nut combinations or threaded screws. The first bracket members 52 are further secured toward a front portion 56 of each of the side walls 26 and 28.

With reference to FIGS. 3 and 4, the first bracket members 52 each include a lower portion 58 having preferably a pair of apertures 60 through which the fasteners 61 described above may extend to secure the lower portion 58 to the sidewall 26. The lower portion 58 is generally planar and has a length sufficient to allow a portion thereof to extend past an upper edge surface 62 of its associated sidewall 26 or 28. Each first bracket member 52 further includes an intermediate portion 64 which extends generally transversely of the lower portion 58 and an upper portion 66 which extends generally transversely of the intermediate portion 64. The upper portion 66 includes an aperture 68 through which a key pin 70 may extend to help secure the upper portion 68 to the side member 36 of the frame 30. The key pin 70 further preferably includes a threaded fastener 72 which is secured to a reinforcing member 74, which is in turn secured such as by wood glue and/or staples or threaded fasteners (not shown) to the side member 36. In this manner the upper portion 66 is effectively "clamped" to the side member 36. It will be appreciated, however, that a single threaded fastener could just as well be positioned through the aperture 68 to fixedly secure the upper portion 66 of the first bracket member 52 directly to the side member 36 of the frame 30 if so desired. With further reference to FIGS. 2 and 3, it will be appreciated that once both of the first bracket members 52 are secured to their respective side walls 26 and 28, a front portion 32 of the frame 30 is fixedly supported near the front edge portions 56 of the side walls 26 and 28.

Referring now to FIGS. 2 and 5, the second bracket members 54 of the mounting apparatus 50 will be described. With specific reference to FIG. 2, each of the second bracket members 54 is secured to the rear cross member 34 of the frame 30 near the outermost end portions of the rear cross member 34. With specific reference to FIG. 5, each of the second bracket members 54 includes a lower ledge portion 76, a central portion 78 extending generally transversely of the lower ledge portion 76, and an upper ledge portion 80 extending generally transversely of the central portion 78. The lower ledge portion 76 includes an aperture 82 through which a threaded fastener 84 may be secured into the rear cross member 34 of the frame 30. Similarly, the upper ledge portion 80 includes an aperture 86 through which a threaded fastener such as a threaded bolt 88 may extend to threadably secure the upper ledge portion 80 to the frame bar 31. Once the second bracket members 54 are secured to the rear cross member 34 and the frame bar 31, a rear portion 90 of the frame 30 is securely supported by the frame bar 31 and the second bracket members. Thus, the entire frame 30 is supported fixedly relative to the side walls 26 and 28.

With reference then to FIGS. 2–6, the apparatus 50 of the present invention enables the frame 30, and thus the entire seating member 18, to be secured to the side walls 26 and 28 after the sidewalls 26 and 28 have been secured to the frame rails 22 via the brackets **24*a*–24*d*. In this manner the seat member 18 may be upholstered at one location while assembly of the sidewalls 26 and 28 proceeds at a separate location. This significantly enhances the assembly process because essentially two separate assembly operations can be performed substantially simultaneously. Accordingly, the overall time required to construct the modular sofa 10 can be reduced. Without the use of the brackets 52 and 54, the frame 30 is typically required to be secured to the sidewalls 26 and 28 and then upholstered. Thus, heretofore it was necessary to perform upholstery of the seating section 18 only after the frame 30 thereof was secured to the sidewalls 26 and 28. Accordingly, the brackets 52 and 54 enable a much more "streamlined" assembly process to be performed which enhances the ease and efficiency with which the sofa assembly 10** can be constructed.

With reference now to FIGS. 2 and 7–9, in the preferred embodiment of the present invention the mounting apparatus 50 further includes a pair of seatback securing brackets 92. The brackets 92 are secured to the arm portions 48 of the side walls 26 and 28. A pair of mating brackets 93 are also secured to the side members 46 of the seatback frame 40 at lowermost ends 94 of the side members 46. Mating bracket members suitable for this purpose are disclosed in U.S. Pat. No. 5,184,871, owned by the assignee of the present application, and hereby incorporated by reference.

With specific reference to FIG. 7, each seatback bracket 92 includes a lower portion 96 having an aperture 98, a lower connecting portion 100 extending laterally from the lower portion 96, a central portion 102 extending laterally of the lower connecting portion 100, an upper portion 104 extending generally transversely of the central portion 102, and a lip portion 106 extending generally transversely of the upper portion 104. The lip portion 106 further includes an aperture 108 which enables a threaded fastener 110 to extend therethrough to securely fix the lip portion 106 to the arm portion 48 of the sidewall 26. To further facilitate securing of the threaded fastener 110, an aperture 112 is formed in the central portion 102 to enable a tool such as a screwdriver, torx driver, nut driver, etc. to be easily used to engage the head portion of the fastener 110. The central portion 102 further includes a notch 114 formed on opposite sides of the central portion 102 in general longitudinal alignment with one another on the central portion 102. The notches 114 may also be curved, as shown in phantom, and the central portion 102 may also be tapered, as also shown in phantom. Tapering the central portion allows for a slightly tighter fit with the mating brackets 93.

Referring specifically to FIG. 9, the seatback bracket member 92 is used to engage the mating bracket member 93 secured to each side member 46 to enable the seatback frame 40 to be quickly and easily secured to the arm portions 48 of the sidewalls 26 and 28.

Thus, when the bracket members 52, 54 and 92 are all incorporated, the seating member 18 and seatback member 20 may each be upholstered at a separate location and subsequently secured to the sidewalls 26 and 28 at a designated assembly location. Enabling the seatback frame 40 to be upholstered at a designated location where primarily upholstery operations take place further simplifies the assembly process by allowing assembly of the sidewalls 26 and 28 to the frame rails 22 to proceed while the seatback frame 40 is being upholstered.

Accordingly, the preferred embodiments described herein significantly simplify and expedite the assembly process for a modular sofa assembly. Specifically, the preferred embodiments enable the sidewalls of a fixed seating section of the sofa assembly to be assembled to the frame rails or other frame-like components of the sofa assembly while the seatback member and seating member of the fixed seating section are simultaneously being upholstered by other workers. Once completely upholstered, the seatback member and seating member may be transported to the location where the sofa assembly is being assembled and thereafter secured to the sidewalls of the fixed seating section.

While the preferred embodiments of the present invention are particularly well adapted for use with fixed seating sections of a modular sofa assembly, it will be appreciated that with little or minor modifications the principles taught herein could be readily applied to recliner seating sections if so desired. The bracket members of the present invention are further relatively inexpensive and relatively easily constructed from suitably strong materials such as metal and do not add significantly to the overall cost of the sofa assembly nor significantly increase the complexity of its assembly.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A mounting apparatus for a modular sofa assembly for removably securing a seat frame to a chair frame, and wherein the chair frame includes a rear frame member fixedly secured to a pair of generally parallel disposed side wall portions, said apparatus comprising:

at least one first bracket member for securing a front portion of the seat frame to one of the side wall portions, said first bracket member including a generally planar lower portion, an intermediate portion extending generally transversely of said lower portion and an upper portion extending generally transversely of said intermediate portion, said upper portion including means by which said upper portion can be secured to said front portion of the seat frame;

a second bracket member for direct coupling to the rear frame member and for securing a rear portion of the seat frame to the rear frame member, said second bracket member including an upper ledge portion adapted to be secured to the rear frame member, a central portion extending generally transversely from said upper ledge portion, and a lower ledge portion adapted to be secured to said rear portion of the seat frame; and whereby the seat frame can be secured to the side wall portions solely by securing the seat frame via said at least one first bracket member and said second bracket member to said one of the side wall portions and the rear frame member respectively.

2. The apparatus of claim 1, further comprising:

a seatback securing bracket for securement to one of the side wall portions, said seatback securing bracket including a central portion having at least one notch formed therein, said seatback securing bracket being adapted to interengage with a removable seatback such that said seatback is positively secured to said one of the side wall portions once engaged with said seatback securing bracket.

3. The apparatus of claim 2, further comprising a pair of said seatback securing brackets with one of each said pair of seatback securing brackets being for securement to respective ones of the side wall portions.

4. The apparatus of claim 1, wherein said at least one first bracket member comprises a pair of said first bracket members, one for incorporating on each side wall portion, to thereby support said front portion of the seat frame fixedly relative to the side wall portions.

5. The apparatus of claim 1, further comprising a pair of said second bracket members, with each one of said pair of second bracket members for securement to the rear frame member at positions closely adjacent the side wall portions, and each one of said pair of second bracket members for being further positioned on the rear frame member to support said rear portion of the seat frame at two positions thereon.

6. The apparatus of claim 1, further comprising means for fastening said first bracket member to said one side wall portion, said fastening means including:

an aperture formed in said upper portion of said first bracket member;

a key pin for extending through said aperture into a hole formed in said front portion of the seat frame; and a threaded fastener for securing said key pin to said front portion of the seat frame.

7. A mounting apparatus for a modular sofa assembly having a pair of parallel disposed side walls and a rear frame bar for securing the side walls apart in accordance with a predetermined spacing, and further having a seating section including a seat frame adapted to fit partially between the side walls, said apparatus comprising:

a pair of first bracket members for securing a front portion of the seat frame to front portions of the side walls, each said first bracket member including a lower portion having at least one aperture therein, an intermediate portion extending laterally of said lower portion, and an upper portion extending laterally of said intermediate portion and having an opening;

fastening means for securing each one of said first bracket members to its respective side wall;

pin means for extending through said openings in said upper portions of said first bracket members and securing said first bracket members to a front portion of the seat frame;

a pair of second bracket members for securing a rear portion of the seat frame to the rear frame bar;

each said second bracket member including a lower ledge portion adapted to abuttingly engage said rear portion of the seat frame, a central portion extending laterally of said lower ledge portion and an upper ledge portion extending laterally of said central portion, said upper ledge portion including an aperture;

fastening means for securing said upper ledge portion of each said second bracket member to the rear frame bar such that said rear portion of the seat frame is supported by said second bracket members;

a pair of seatback securing brackets for securement to upper side portions of each one of the side walls for releasably coupling a seatback member to the side walls, each said seatback securing bracket including a central portion having a notch formed therein, a lower portion having an aperture and an upper portion having an aperture, and fastening means extending through said apertures in said upper and lower portions of said seatback bracket for securing said seatback bracket to its associated side wall;

whereby said first and second bracket members permit the seat frame to be upholstered at a remote location and subsequently secured to the side walls of the seating section; and whereby said seatback brackets permit said seatback member to be upholstered at a remote location and subsequently secured to the side walls to thereby facilitate modular assembly of the seating section.

* * * * *

UNITED STATES PATENT AND TRADEMARK OFFICE

CERTIFICATE OF CORRECTION

PATENT NO. : 5,518,298

DATED : May 21, 1996

INVENTOR(S) : Larry P. LaPointe, et al.

It is certified that error appears in the above-indentified patent and that said Letters Patent is hereby corrected as shown below:

On the Title Page under U.S. Patent Documents;
insert the following:

-- 3,841,701 10/1974 Sullivan --;
-- 3,893,729 7/1975 Sherman et al. --;
-- 4,114,947 9/1978 Nelson --;
-- D.260,058 8/1981 Ponzellini --;
-- 4,311,337 1/1982 Brunn --;
-- D.265,952 8/1982 Theodore --;
-- D.268,551 4/1983 Raftery et al. --;
-- D.268,552 4/1983 Raftery et al. --;
-- 4,395,071 7/1983 Laird --;
-- 4,595,164 6/1986 Froutzis et al. --;
-- 4,740,031 4/1988 Rogers, Jr. --.

On the Title Page under Attorney, Agent, or Firm

"Harness, Dickey & Pierce" should be -- Harness, Dickey & Pierce, P.L.C. --.

Column 3, line 2
"." (second occurrence in patent) should be -- ; --.

UNITED STATES PATENT AND TRADEMARK OFFICE

CERTIFICATE OF CORRECTION

PATENT NO. : 5,518,298

DATED : May 21, 1996

INVENTOR(S) : Larry P. LaPointe, et al.

It is certified that error appears in the above-indentified patent and that said Letters Patent is hereby corrected as shown below:

Column 3, line 7
"." (second occurrence in patent) should be -- ; --.

Column 3, line 37,

"24" should be -- 24a-24d --.

Signed and Sealed this

Seventeenth Day of September, 1996

Bruce Lehman

*Attest:*

BRUCE LEHMAN

*Attesting Officer*

*Commissioner of Patents and Trademarks*